US005731644A

United States Patent [19]

Drlik

[11] Patent Number: 5,731,644

[45] Date of Patent: Mar. 24, 1998

[54] INTEGRAL COOLING AIR DIFFUSER FOR ELECTROMECHANICAL APPARATUS

[75] Inventor: Martin F. Drlik, Seven Hills, Ohio

[73] Assignee: Lucas Aerospace Power Equipment Corporation, Aurora, Ohio

[21] Appl. No.: 397,400

[22] Filed: Mar. 2, 1995

[51] Int. Cl.[6] ..... H02K 9/00; H02K 9/06

[52] U.S. Cl. ..... 310/58; 310/59; 310/53

[58] Field of Search ..... 310/58, 59, 53, 310/62, 63, 89

[56] References Cited

U.S. PATENT DOCUMENTS

| | | | |
|---|---|---|---|
| 2,494,471 | 1/1950 | Claytor | 310/58 |
| 2,604,501 | 7/1952 | Wightman | 310/63 |
| 2,970,233 | 1/1961 | Penney | 310/63 |
| 3,073,976 | 1/1963 | Wesolowski | 310/59 |
| 3,648,086 | 3/1972 | Renner et al. | 310/63 |
| 4,680,493 | 7/1987 | Ziegler et al. | 310/62 |
| 5,311,089 | 5/1994 | Stroetgen et al. | 310/58 |

FOREIGN PATENT DOCUMENTS

| | | |
|---|---|---|
| 0343888 | 11/1989 | European Pat. Off. . |
| 0387987 | 9/1990 | European Pat. Off. . |
| 524910 | 8/1940 | United Kingdom . |
| 624273 | 6/1949 | United Kingdom . |
| 1108775 | 4/1968 | United Kingdom . |
| 1417154 | 12/1975 | United Kingdom . |

*Primary Examiner*—Clayton E. LaBalle
*Attorney, Agent, or Firm*—Rankin, Hill, Porter & Clark LLP

[57] ABSTRACT

An integral cooling air diffuser for a starter/generator of the type having an air inlet and a cooling fan for blowing cooling air from the air inlet into the starter/generator through the diffuser, the diffuser having a number of aerodynamic vanes for efficiently directing air flow into the starter/generator. In one embodiment the vanes are in the general shape of an aerodynamic air foil.

21 Claims, 2 Drawing Sheets

INTEGRAL COOLING AIR DIFFUSER FOR ELECTROMECHANICAL APPARATUS

BACKGROUND OF THE INVENTION

1. Field of the Invention

This invention relates generally to methods and apparatus for providing cooling air flow during operation of electromechanical apparatus such as are often used, for example, as starter/generators on turbine engines. More particularly, the invention relates to an air flow device for improving starter/generator cooling.

2. Description of the Prior Art

It is well known to use generators as starters for motors and engines. For example, in the aerospace industry, DC generators are commonly used as engine starters on small aircraft engines such as gas turbine engines. After the engine is started, the generator typically is used as an electrical power source, i.e. a generator, for the aircraft.

As a starter/generator for an engine, the generator armature is supplied electrical energy typically from a starter battery. The generator develops substantial torque initially to begin turning the engine. In a typical DC shunt generator, the armature current also is used to supply the field excitation current.

As is further known, electromechanical apparatus such as starter/generators can develop substantial internal temperatures. This heat can have adverse effects on the electrical components used with the generator. Therefore, known starter/generator designs typically include a propeller-type blower fan that is mounted adjacent an end bell and that draws outside air into the starter/generator for cooling the starter/generator interior. It is also known to include with the end bell a plurality of ribs or spokes that connect a bearing hub with an outer rim adjacent the fan. These spokes customarily have a rectangular cross-section that present blunt transverse surfaces to the air flow stream from the fan. This results in a disrupted air flow with resultant kinetic energy and pressure losses.

The objectives exist, therefore, to provide an integral improved air flow arrangement for electromechanical apparatus that increases the volume and pressure of cooling air blown into the apparatus interior.

SUMMARY OF THE INVENTION

To the accomplishment of the foregoing objectives, the invention contemplates, in one embodiment, a cooling air flow device for a starter/generator, comprising a hub, an outer rim and a number of aerodynamic vanes disposed generally radially to connect the hub and rim; wherein the air flow device efficiently directs a generally axial cooling air flow into the starter/generator.

These and other aspects and advantages of the present invention will be readily understood and appreciated by those skilled in the art from the following detailed description of the invention with the best mode contemplated for practicing the invention in view of the accompanying drawings.

DETAILED DESCRIPTION OF THE PREFERRED EMBODIMENT

Figure 1:
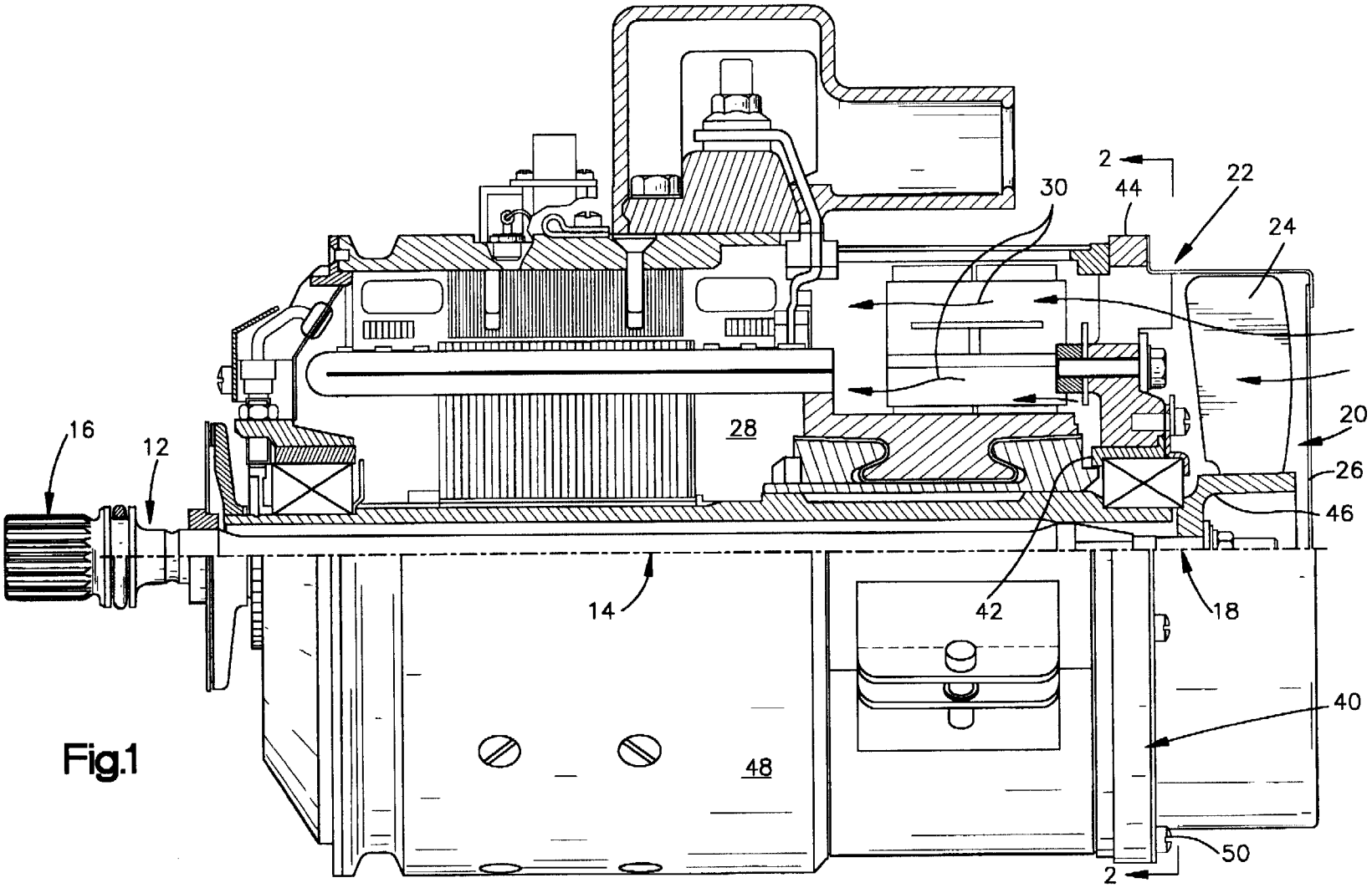
FIG. 1 is a schematic diagram in partial longitudinal cross-section of a typical starter/generator system configured with an embodiment of the present invention.

With reference to the drawings, an embodiment of the invention is illustrated in an exemplary manner in combination with an electromechanical apparatus such as a starter/generator generally designated with the reference numeral 10. Although the invention is described herein with reference to a specific type of electromechanical apparatus and starter/generator, those skilled in the art will readily appreciate that this description is for purposes of illustration and understanding of the concepts and advantages of the invention and not intended to be limited to a particular application or use. The present invention can be readily incorporated into many different types of air cooled electromechanical apparatus.

A typical starter/generator 10 includes a power drive shaft 12 along its longitudinal drive axis 14. Typically, the power shaft 12 includes a drive end spline 16 suitably adapted for being coupled to an engine shaft (not shown). At the anti-drive end 18 a propeller-type fan 20 is coupled to the drive shaft 12 within an air inlet assembly 22. The fan 20 typically includes a plurality of rotatable fan blades 24 that draw cooling air into the starter/generator air inlet cap 26. The fan 20 adds kinetic energy to the cooling air and blows it inward to the starter/generator interior 28 as represented by the directional arrows 30. Typically, the air flow exiting the fan has a vortical flow pattern.

In the illustrated embodiment, a cooling air diffuser is integrally formed as part of an end bell assembly 40 that is mounted on the anti-drive end 18 of the starter/generator 10, adjacent to the fan 20. The end bell 40 is commonly used as a support structure for brush holder assemblies, terminal blocks and so forth. In this example, the end bell 40 includes a bearing mounted hub 42 and an outer rim 44. The hub 42 is mounted on the drive shaft 12 via a bearing assembly 46. The outer rim 44 can be attached to the starter/generator housing 48 by any convenient means such as screws 50. Those skilled in the art will readily appreciate that an air flow diffuser in accordance with the invention can be made part of or separate from an end bell assembly and/or the fan 20 assembly. Further, a cooling air flow diffuser in accordance with the invention can be used for electromechanical devices that do not contain an integral cooling fan but receive a cooling air flow from an external source.

The hub 42 and outer rim 44 are connected by a plurality of aerodynamic vanes 60 radially disposed in a manner similar to spokes on a wheel. The radial dimension of each vane will depend on each particular application. In the example described herein, most of the vanes 60 extend the full distance between the hub 42 and the rim 44. In other cases, some of the aerodynamic vanes extend about half the radial distance from the hub 42 to the rim 44, and such vanes are indicated with the numeral 62 in the drawings. These half-vanes can be used for example, where a flat outer surface of the vane is needed, such as for mounting a terminal 64, for example.

Figure 2:
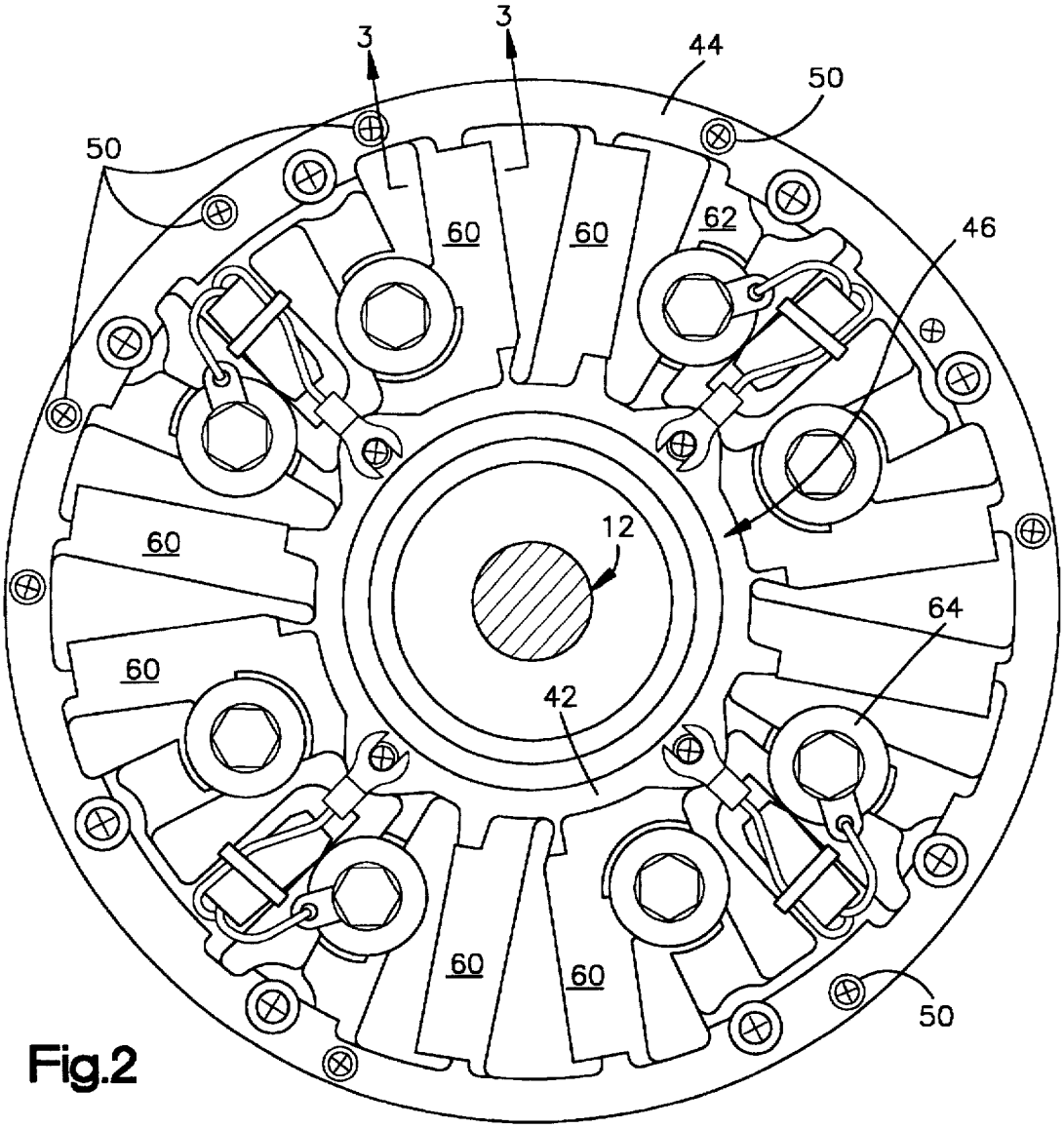
FIG. 2 is an elevation of a cooling air diffuser used with the starter/generator of FIG. 1 as viewed from the section line 2—2 and embodying the concepts of the present invention.
Figure 3:
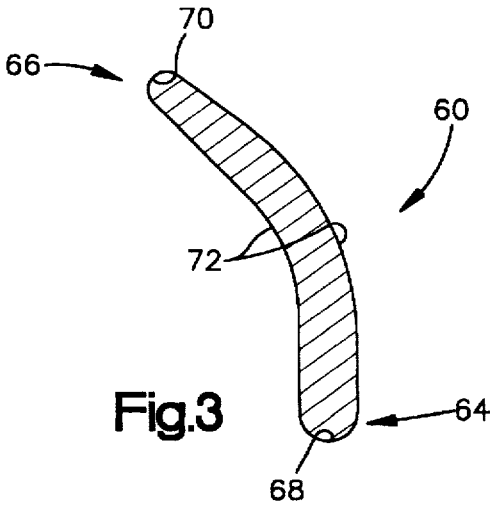
FIG. 3 is an illustration of one embodiment of an aerodynamic vane in accordance with the invention, taken in transverse section through the vane along line 3—3 of FIG. 2.

FIG. 3 illustrates one example of an aerodynamic vane 60 design in accordance with the invention. This view is taken along line 3—3 of FIG. 2 and illustrates a vane in transverse cross-section along the drive shaft axis 14. In contrast to a conventional spoke which would be parallel to the drive axis and rectangular in section, each aerodynamic vane 60, 62 is preferably arcuate in shape, in the nature of an airfoil, and tapers from an inlet end 64 to an outlet end 66. The ends 64, 66, and especially the inlet end 64, are preferably formed with a radius 68, 70 to present a non-transverse surface to the air flow. For tapered vanes as illustrated herein, the outlet radius 68 can be sized larger than the inlet radius 70.

Each vane 60 includes air directing surfaces 72. Each airfoil-like vane 60 captures air leaving the fan 20 and can be optimally angled to smoothly redirect the fan cooling air in an axial direction with a reduced energy loss. The non-transverse ends of each vane, particularly in this case radius ends 68, provide minimal air flow interruption. Other vane end configurations can be used depending on a particular application such as tapered ends (not shown). The airfoil-like vanes further act like an axial-flow diffuser thus re-directing the air flow through the starter/generator 10 with a minimum of energy loss. The vanes 60 can be integrally formed with the diffuser end bell 40 or separately attached.

In operation, the fan 20 draws cooling air into the inlet cap 26 and accelerates the air flow, typically in a vortical pattern. The diffuser end bell 40, and the aerodynamic vanes 60, 62 in particular, catch the fan air flow and redirect it at increased pressure in an axial direction through the starter/generator 10. Additional fan/diffuser assemblies can be used at the drive end of the starter/generator (not shown) if so desired to further increase air flow therethrough.

By integrating the diffuser into a conventional end bell assembly, the invention provides a simple and cost effective way to increase cooling air flow through an electromechanical apparatus without increasing parts and cost or affecting the envelope of the apparatus or the structural integrity of the end bell. The use of aerodynamic vanes significantly increases air flow through the apparatus thus reducing temperatures of the starter/generator components.

The invention has shown and described with reference to a propeller-type fan 20 which rotates in one direction and a diffuser having vanes 60, 62 which are designed to re-direct the flow of air from the fan into an axial direction, and the vanes are thus designed in accordance with the direction of rotation of the fan. It should be understood that, if the fan is designed to rotate in the opposite direction, e.g. counter-clockwise instead of clockwise, the vanes would be designed to extend in the opposite direction to re-direct the air flow from such a fan toward the axial direction as before.

Other variations and modifications of the specific embodiments herein shown and described will be apparent to those skilled in the art, all within the intended spirit and scope of the invention. While the invention has been shown and described with respect to particular embodiments thereof, these are for the purpose of illustration rather than limitation. Accordingly, the patent is not to be limited in scope and effect to the specific embodiments herein shown and described nor in any other way that is is inconsistent with the extent to which the progress in the art has been advanced by the invention.

What is claimed is:

1. In combination, a cooling air diffuser, an electromechanical starter/generator having an air inlet and an interior that is axially spaced from said air inlet, and a cooling fan for blowing cooling air from the air inlet into the starter/generator through the diffuser; said diffuser being disposed axially between said fan and said starter/generator interior; said diffuser comprising a hub and an outer concentric rim and having a number of aerodynamic airfoil shaped vanes radially connected between said hub and said rim for directing air flow into the starter/generator interior.

2. The combination of claim 1, wherein said vanes provide a generally axial air flow into the starter/generator.

3. The combination of claim 1, wherein the fan produces a vortical cooling air flow and the air flow from the diffuser is a generally axial air flow.

4. The combination of claim 1, wherein each vane is arcuate in transverse section taken along the starter/generator drive axis.

5. The combination of claim 1, wherein said hub and rim are concentrically disposed along the starter/generator drive axis with each vane generally extending longitudinally along the drive axis.

6. The combination of claim 5, wherein each vane is arcuate in transverse section taken along the starter/generator drive axis.

7. The combination of claim 1 wherein each vane has a pair of arcuate surfaces that direct air flow into the starter/generator, said surfaces being joined by diffuser inlet and outlet radial vane ends.

8. The combination of claim 1 wherein each vane has a first radial end disposed adjacent the cooling fan outlet.

9. The combination of claim 1, including an end bell assembly covering the cooling fan, the diffuser being integral with the end bell assembly.

10. The combination of claim 1, wherein the vanes efficiently direct the air flow with a minimum of energy loss.

11. A cooling air flow device for an electromechanical starter/generator, comprising: a hub, an outer rim and a number of aerodynamic airfoil shaped vanes disposed generally radially to connect said hub and rim; said air flow device being disposed axially between an air inlet to the starter/generator and an interior region in the starter/generator; said air flow device directing a generally axial vortical cooling air flow into the starter/generator interior.

12. The device of claim 11, wherein each vane is arcuate in transverse section taken along the starter/generator drive axis.

13. The device of claim 11, wherein said hub and rim are concentrically disposed along the starter/generator drive axis with each vane generally extending longitudinally along the drive axis.

14. The combination of claim 13, wherein each vane is arcuate in transverse section taken along the starter/generator drive axis.

15. The combination of claim 14, wherein each vane has a pair of arcuate surfaces that direct air flow from a cooling fan into the starter/generator, said surfaces being joined by inlet and outlet radial vane ends.

16. In an electromechanical apparatus of the type having an air inlet for receiving a cooling air flow into the electromechanical apparatus interior, the improvement comprising: a cooling air diffuser disposed between the air inlet and the electromechanical apparatus interior for directing air flow into the apparatus interior, said diffuser having a hub and an outer concentric rim and a number of aerodynamic airfoil shaped vanes for directing said air flow; said vanes being radially connected between said hub and rim.

17. The combination of claim 16, wherein said vanes provide a generally axial air flow into the electromechanical apparatus at an increased pressure compared to the inlet air pressure.

18. The combination of claim 16, wherein the electromechanical apparatus includes a cooling fan that draws air into the air inlet and blows cooling air into the diffuser, and further wherein the fan produces a vortical cooling air flow and the air flow from the diffuser is a generally axial air flow.

19. The combination of claim 18, wherein the electromechanical apparatus includes an end bell assembly covering the cooling fan, the diffuser being integral with the end bell assembly.

20. The combination of claim 16, wherein each vane is arcuate in transverse section taken along an electromechanical apparatus drive axis.

21. The combination of claim 16, wherein each vane is in the shape of an air foil.

* * * * *